US005713222A

United States Patent [19]

Johnson

[11] Patent Number: 5,713,222

[45] Date of Patent: Feb. 3, 1998

[54] AUTOMATIC WASHING MACHINE WATER INLET

[75] Inventor: Dwight David Johnson, Columbus, Ohio

[73] Assignee: General Electric Company, Louisville, Ky.

[21] Appl. No.: 431,579

[22] Filed: May 1, 1995

[51] Int. Cl.[6] ..... D06F 39/08

[52] U.S. Cl. ..... 68/23.5; 68/207; 239/521; 239/590

[58] Field of Search ..... 68/207, 23.5; 239/521, 239/523, 590, 590.5

[56] References Cited

U.S. PATENT DOCUMENTS

| | | | |
|---|---|---|---|
| 2,552,398 | 5/1951 | Briggs | 68/207 |
| 2,638,112 | 5/1953 | Shelton | 137/216 |
| 3,605,455 | 9/1971 | Olthuis | 68/207 |
| 3,948,064 | 4/1976 | Sauer et al. | 68/207 |
| 4,000,968 | 1/1977 | Schrage et al. | 68/207 |
| 4,186,573 | 2/1980 | Brenner | 68/207 |
| 4,754,622 | 7/1988 | Fanson | 68/207 |
| 5,031,426 | 7/1991 | Wilson | 68/207 |

FOREIGN PATENT DOCUMENTS

| | | | |
|---|---|---|---|
| 60-2282 | 1/1985 | Japan | 68/207 |
| 60-90597 | 5/1985 | Japan | 68/207 |
| 61-280888 | 12/1986 | Japan | 68/207 |
| 63-24996 | 2/1988 | Japan | 68/207 |

*Primary Examiner*—Frankie L. Stinson
*Attorney, Agent, or Firm*—H. Neil Houser

[57] ABSTRACT

A fabric washing machine includes a container to receive water and fabrics to be washed in the water and an unitary inlet member for supplying water to the container. The inlet member includes a flexible conduit section connected to a source of water and a nozzle section with one end connected in fluid flow relationship with the conduit section. The nozzle section has spaced apart top and bottom walls joined by spaced apart side walls. The distance between the side walls becomes larger in the direction away from the conduit section. The top wall has a downwardly curved distal end portion remote from the conduit section and the bottom wall terminates generally adjacent the position at which the downwardly curved portion of the top wall begins.

12 Claims, 2 Drawing Sheets

39
38
40
47
46
48
37
36
34
35
49
62
50
63
45
51
53
54
52
56
59

22
34
36
38
35
60
16
51
62
63
56
40
57
13
59
50
52
53
49
48
46
14
45
31
30

56
51
58
52

AUTOMATIC WASHING MACHINE WATER INLET

BACKGROUND OF THE INVENTION

This invention relates to automatic clothes washers or washing machines of the upright type, that is such machines in which the fabrics are washed in a vertically disposed container. More particularly, this invention relates to an improved water inlet member for directing fill water to such a container. It is common practice to automatically supply clothes washers with the desired amount of water at the desired temperature. The fill mechanism has at least two functions. First, it transports the water from the inlet valve mechanism to the container. Second, it provides an air break between the container and water valve mechanism so that dirty water can not be drawn from the container into the water supply system. It is desirable that the fill mechanism deliver the water to the container in a spray or stream that is relatively quiet and does not cause the water to splash.

It is an object of this invention to provide an improved water fill mechanism for automatic washing machines, It is another object to provide such an improved mechanism that is an unitary molded inlet member.

It is yet another object of this invention that the inlet member provides water to the container in a quiet stream, with little if any splashing of the water.

SUMMARY OF THE INVENTION

According to one embodiment of the present invention an automatic washing machine includes a container to receive water and fabrics to be washed in the water. A housing encloses the container and includes a support member positioned adjacent the open top of the container. A water inlet valve mechanism is mounted adjacent to the support member and includes a water outlet. An unitary water inlet member is mounted on the support member. The inlet member includes a conduit section, connected to the fluid outlet of the valve mechanism, and a nozzle section having an inlet receiving water from the conduit section and an outlet to discharge water into the container. The nozzle section has spaced apart top and bottom walls, and the width of the walls increases in the fluid flow down stream direction. The top wall has a downwardly curved outlet end portion and the bottom wall terminates short of the distal edge of top wall downwardly curved outlet portion to form the nozzle outlet.

DETAILED DESCRIPTION OF PREFERRED EMBODIMENT

Figure 1:
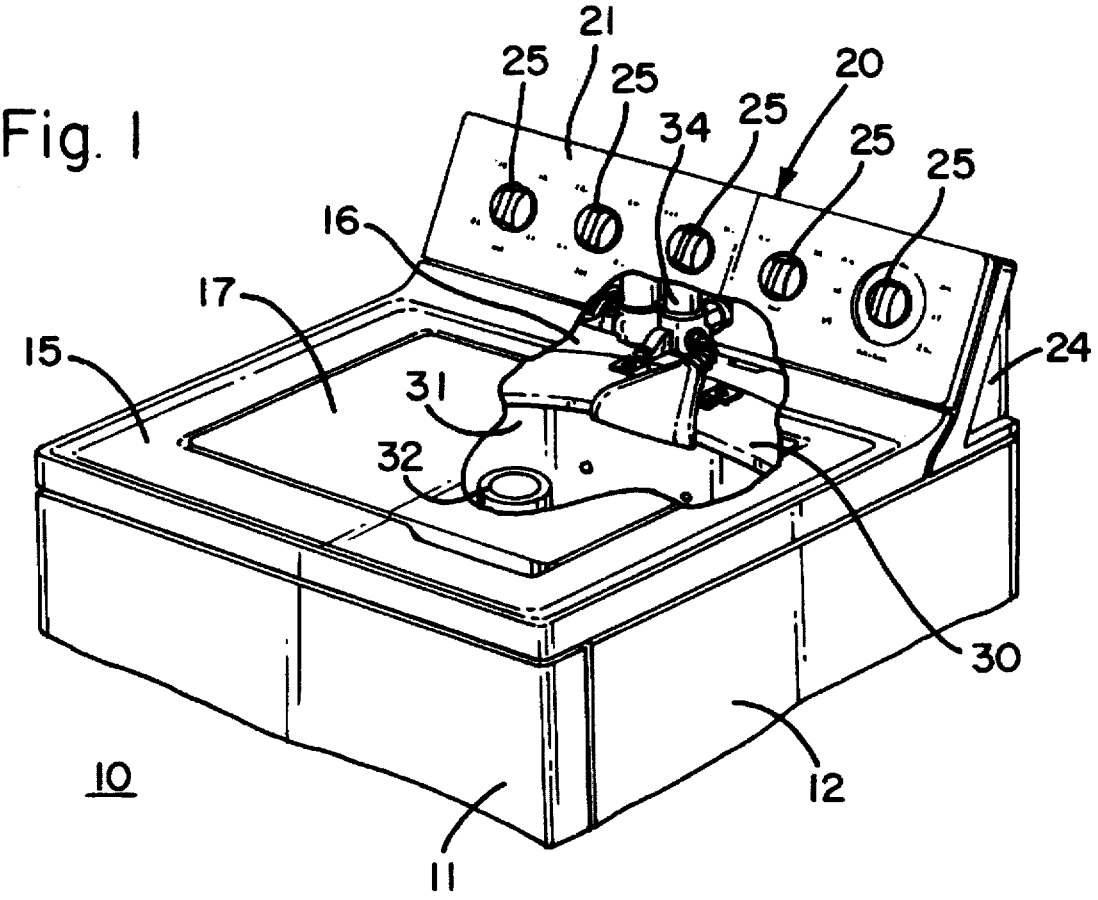
FIG. 1 is a partial perspective view of a clothes washing machine according to certain principals of the present invention, the view being partly broken away to illustrate certain aspects of the water supply mechanism.

Referring now to the drawings, an automatic fabric washing machine 10, often called a clothes washer, is illustrated.

The washer 10 includes an outer cabinet with a front wall 11, side walls 12,13, and a rear wall 14 The top of the rectangular, box like housing formed by walls 11–14 is closed by a top including a front top, or cover, panel 15 and a rear top, or cover, panel 16. An opening is provided in the front top panel and a door 17 is hinged to the panel 15 to provide access to the inside of the housing through the opening. A control housing 20, commonly referred to as a back splash, is mounted over the rear top panel 16 and includes a front wall 21 and a rear wall 22 joined by spaced apart end caps, one of which is shown at 24. Various controls for controlling operation of the machine 10 are mounted in the backsplash and have operators, like control knobs 25, for user selection of various aspects of the operation of machine 10. Controls, other than the water inlet arrangement which will be described in more detail hereinafter, do not form part of the and have been omitted for the sake of simplicity.

A generally cylindrical imperforate container 30, generally referred to as the tub, is mounted in the housing and receives a body of fluid in which the fabrics are washed and rinsed. A generally cylindrical perforated cylinder 31, generally referred to as the basket, is mounted in the tub 30 to receive the fabrics to be washed and rinsed. As the basket is perforated, the fluid in the tub 30 also fills the basket 31. An agitator 32 is mounted in the center of the basket 31 to selectively agitate the fabrics and fluid for washing and rinsing the fabrics.

The fluid in the tub is water, with detergent added, for washing the fabrics and plain water for rinsing the fabrics. If desired a fabric softener can be added to the water in a final rinse. The desired amount of water at the desired temperature is automatically added to container 30 for each washing and rinsing operation of machine 30. To this end an inlet water valve mechanism 34 is mounted in the back splash 20. Preferably the valve mechanism 34 is mounted on rear top panel 16 by suitable means, such as bolts 35. The valve mechanism 34 conveniently is a well known mixing valve of the variable flow rate type. More specifically the mechanism 34 has two electrically operated valves 36, 37 respectively. One valve 36 is connected to the cold water supply by an inlet 38 and the other valve 37 is connected to the hot water supply by an inlet 39. Thus by adjusting one of the control knobs 25, the user can choose cold water, hot water or a mixture of hot and cold water. The exemplification valve mechanism 34 is of the variable flow type, that is the rate of flow varies depending on the pressure of the incoming water. For example the flow may vary between 2 gallons per minute with 20 p.s.i. inlet pressure and 12 gallons per minute with 120 p.s.i. inlet pressure. The incoming water is mixed in the valve mechanism 34 and flows out of the mechanism through an outlet 40.

A water inlet member 45 receives the water from the valve mechanism outlet 40 and discharges it into the top of the container or tub 30. The inlet member 45 is a hollow unitary structure, preferably blow molded of a suitable plastic material, such as the material sold by Monsanto under the name Santoprene. The inlet member 45 includes an elongated conduit section 46 with an inlet end 47 attached to the valve outlet 40 to receive water from the valve. The conduit 46 is corrugated so that it will flex for easy installation in the tight space of the backsplash. The outlet end 48 of the conduit section 45 connects to a nozzle section 49, which has a top wall 51 spaced apart from a bottom wall 52. The lateral edges of walls 51,52 are joined by spaced apart side walls 53,54. Viewing FIG. 2, it will be seen that the top and bottom walls diverge in the direction away from the conduit section. Stated another way the walls 51,52 become wider and the side walls 53,54 get further apart in the down stream direction of the water flowing through the nozzle. Viewing FIG. 4, it will be seen that the top and bottom walls converge in the vertical direction, that is they get closer together in the downstream direction. The net result is that the stream of water becomes wider and thinner as it flows through the nozzle section. It will be recognized that the lateral divergence is significantly greater than the vertical convergence so that the cross section area of the channel defined by nozzle walls 51–54 increases in the down stream direction. This diffuses and slows down the water and provides a stream or spray that is quiet and results in minimal splashing, even at maximum water pressure.

Figure 2:
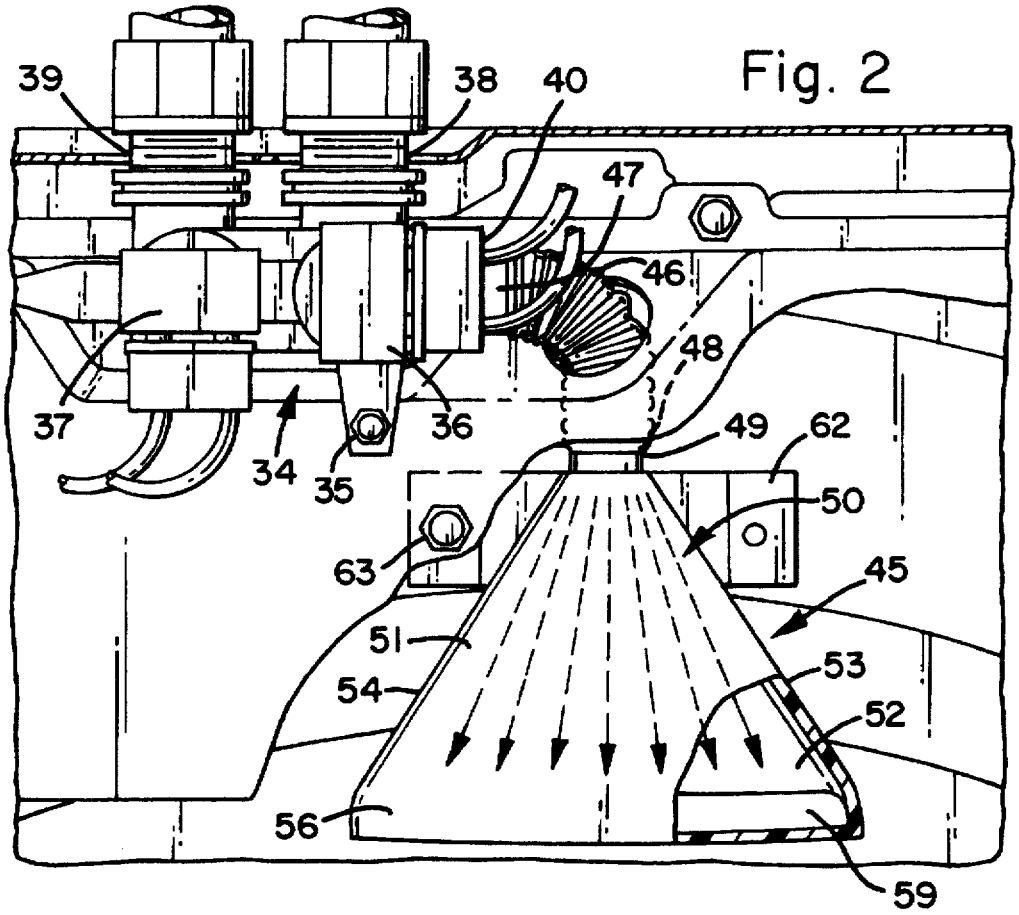
FIG. 2 is a fragmentary plan view of a portion of the machine of FIG. 1, with the rear cover panel and parts of the back splash broken away for purposes of illustrating certain aspects of the water supply mechanism.
Figure 3:
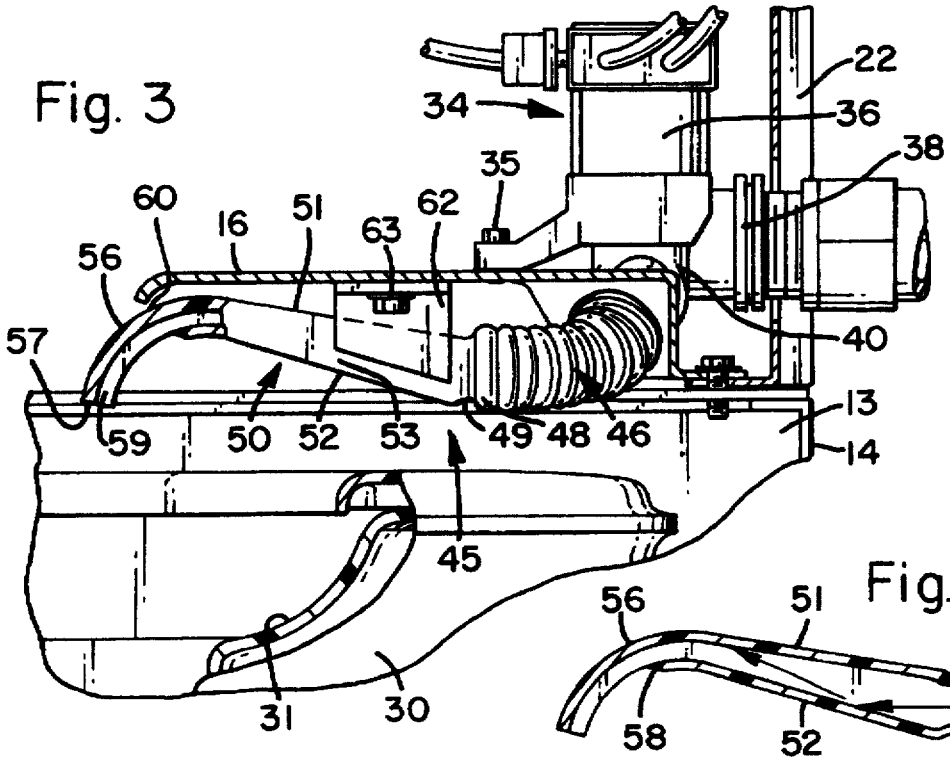
FIG. 3 is a fragmentary side elevation view illustrating the water supply mechanism.
Figure 4:
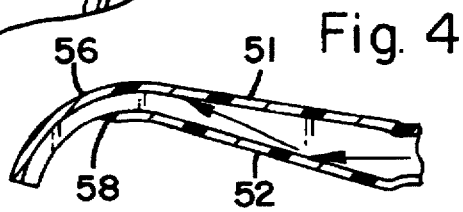
FIG. 4 is a fragmentary side elevation cross section view of the nozzle section of the inlet member of the machine of FIG. 1.

Viewing particularly FIGS. 3 and 4, the outlet end portion 56 of top wall 51 is curved downwardly and preferably is a radiused curve that extends through approximately a ninety degree angle to a distal edge 57. The distal edge, or end, 58 of the bottom wall 52 is well short of the top wall edge distal 57. Preferably the bottom wall distal edge 58 is approximately aligned with the position at which the top wall 57 begins to curve downward. As best seen in FIG. 2, the side walls 53,54 are coextensive with top wall 51. Thus the walls 51–54 define an outlet opening 59 for the water flowing through the nozzle section 50.

Referring now to FIGS. 2 and 3, it will be seen that the inlet member 45 is mounted on the under side of the rear cover member 16 by means of a bracket 62 that fits under the nozzle section 50 and is secured to the cover member 16 by bolts 63. Thus rear cover member 16 serves as the support member for the inlet member 45. As best seen in FIG. 3, the inlet member is molded with the nozzle section 50 angling upward from the conduit section 46. Thus, when the water inlet member is mounted under cover member 16, the junction between conduit section outlet 48 and nozzle section inlet 49 is spaced well below member 16 and the beginning 60 of nozzle section top wall down turned outlet end portion 56 is closely adjacent the front edge of the rear cover member 16. The reaction force of the water flowing through the inlet member 45 will cause the top wall to engage the edge of the cover member 16 with a generally line contact at the beginning 60 of the down turned portion 56. This provides a stable mounting for the inlet member 45.

As best seen in FIG. 3, the outlet opening 59 of nozzle section 50 is positioned in line with and well above the top of container 30. This assures that the stream of water exiting from the nozzle 50 is directed generally vertically downward just inside the peripheral walls of container 30. At the same time the substantial distance of outlet opening 59 above the top of container 30 provides the air brake needed to assure that water is not inadvertently drawn back into the water supply system from container 30.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. In a washing machine including a container to receive fluid and fabrics to be washed in the fluid, an inlet member for supplying fluid to the container, said inlet member comprising:

a conduit section for connection to a source of fluid;

a nozzle section in fluid flow relationship with said conduit section;

said nozzle section comprising spaced apart top and bottom walls joined by spaced apart side walls, the spacing between said side walls becoming larger in the direction away from said conduit section, said top and bottom walls extending over the container;

said top wall comprising a downwardly curved distal end portion remote from said conduit section;

and said bottom wall comprising a distal edge approximately about aligned with a position at which said downwardly curved distal end portion of said top wall begins.

2. A fluid inlet member as set forth in claim 1, wherein: said inlet member is formed of a blow molded plastic material.

3. A fluid inlet member as set forth in claim 1, wherein: said top and bottom walls converge toward each other in the direction away from said conduit section.

4. A fluid inlet member as set forth in claim 1, wherein: said distal end portion of said top wall has a radiused curve.

5. A fluid inlet, member as set forth in claim 1, wherein: said conduit section is corrugated.

6. A fabric washing machine comprising:

a container to receive fluid and fabrics to be washed in the fluid, said container having an open top;

a housing enclosing said container, said housing comprising a support member positioned adjacent said open top of said container;

a fluid inlet valve mechanism mounted adjacent said support member and comprising a fluid outlet;

an unitary fluid inlet member mounted to said support member, said fluid inlet member comprising a conduit section connected to said fluid valve mechanism outlet to receive fluid therefrom;

said inlet member further comprising a nozzle section having an inlet in fluid flow relationship with said conduit section and an outlet positioned to discharge fluid into said container;

said nozzle section comprising spaced apart top and bottom walls, the width of said top and bottom walls becoming larger in the direction away from said conduit section, said top and bottom walls extending over the container;

said top wall comprising a downwardly curved outlet end portion and a distal edge, said bottom wall terminating at a location closer to a position at which said downwardly curved outlet end portion of said top wall begins than to said distal edge of said top wall downwardly curved outlet end portion to form said nozzle outlet.

7. A fabric washing machine as set forth in claim 6, wherein: said inlet member is mounted on the bottom of said support member with said nozzle section outlet positioned above said open top of said container.

8. A fabric washing machine as set forth in claim 6, wherein:

a bracket mounts said inlet member under said support member with the end of said nozzle section top wall adjacent said conduit section spaced below said mounting member; and said nozzle section top wall includes a portion inclined upwardly from its end adjacent said conduit section to its downwardly curved distal end portion and engages said mounting member adjacent the junction of its upwardly inclined portion and its downwardly curved portion.

9. A fabric washing machine as set forth in claim 6, wherein: said inlet member is formed of a blow molded plastic material.

10. A fabric washing machine as set forth in claim 6, wherein: said nozzle section top and bottom walls converge toward each other in the direction away from said conduit section.

11. A fabric washing machine as set forth in claim 6, wherein: said distal end portion of said nozzle section top wall has a radiused curve.

12. A fabric washing machine as set forth in claim 6, wherein: said conduit section is corrugated.

* * * * *